US009289027B2

(12) United States Patent
Wadman et al.

(10) Patent No.: US 9,289,027 B2
(45) Date of Patent: Mar. 22, 2016

(54) FOOTWEAR ITEM

(76) Inventors: Marcel Wadman, Dorchester (GB); Alexis Wadman, Amstelveen (NL)

( * ) Notice: Subject to any disclaimer, the term of this patent is extended or adjusted under 35 U.S.C. 154(b) by 1038 days.

(21) Appl. No.: 13/000,764

(22) PCT Filed: Jun. 24, 2009

(86) PCT No.: PCT/GB2009/050722

§ 371 (c)(1),
(2), (4) Date: Apr. 27, 2011

(87) PCT Pub. No.: WO2009/156758

PCT Pub. Date: Dec. 30, 2009

(65) Prior Publication Data

US 2011/0192051 A1 Aug. 11, 2011

(30) Foreign Application Priority Data

Jun. 24, 2008 (GB) ..... 0811550.3

(51) Int. Cl.
*A43B 13/38* (2006.01)
*A43B 23/00* (2006.01)
(Continued)

(52) U.S. Cl.
CPC ..... *A43B 7/144* (2013.01); *A43B 3/0042* (2013.01); *A43B 7/1465* (2013.01); *A43B 7/16* (2013.01); *A43B 7/24* (2013.01); *A43B 17/02* (2013.01); *A43B 17/023* (2013.01)

(58) Field of Classification Search
CPC ..... A43B 7/144; A43B 7/1465; A43B 7/24; A43B 7/16; A43B 7/142; A43B 7/14; A43B 7/38; A43B 7/28; A43B 17/023; A43B 17/02; A43B 3/0042; A43B 3/0047; A43B 13/41; A43B 21/433; A43B 21/42; A43B 21/32; A43B 21/52; A43B 19/00; A43B 19/005; A63B 69/3673; A61F 5/14; A61F 5/0111; A61F 5/0127; A61F 5/0195
USPC .... 36/25 R, 27–29, 30 R, 34 R, 36 R, 37, 39, 36/41–44, 71, 88, 100, 105, 127, 140–144, 36/149, 150, 155–158, 160–163, 172, 36/159; 12/142 N
See application file for complete search history.

(56) References Cited

U.S. PATENT DOCUMENTS 2,160,238 A * 5/1939 Turner ..... 36/143
2,616,190 A * 11/1952 Darby ..... 36/144
(Continued)

FOREIGN PATENT DOCUMENTS

EP 0746990 12/1996
EP 1118282 A2 7/2001
(Continued)

OTHER PUBLICATIONS

U.K. Search Report Under Section 17, Intellectual Property Office, 2 pgs., Nov. 14, 2008.
(Continued)

*Primary Examiner* — Alissa L Hoey
*Assistant Examiner* — Jameson Collier
(74) *Attorney, Agent, or Firm* — Renner Kenner Greive Bobak Taylor & Weber

(57) ABSTRACT

A footwear item (1) for tilting a wearer's foot to address bio-mechanical problems. The item includes a foot receiving component (2) for receiving all or part of a wearer=s foot. The item also includes first and second wedge components (4,5), each having first and second respectively inclined surfaces (4*a*, 4*b*, 5*a*, 5*b*), the first surface (4*a*) of the first wedge component being mountable against a lower surface of the foot receiving component, and the first surface (5*a*) of the second wedge component being mountable against the second surface (5*b*) of the first wedge component. The mounted position of the second wedge component on the first wedge component is rotationally adjustable about an axis perpendicular to the second surface of the first wedge component, for altering the angle of inclination of the second surface (5*b*) of the second wedge component with respect to the first surface (4*a*) of the first wedge component, to thereby apply an adjustable tilt to the foot receiving component.

14 Claims, 4 Drawing Sheets

(51) Int. Cl.

| | |
|---|---|
| ***A43B 7/14*** | (2006.01) |
| ***A43B 3/00*** | (2006.01) |
| ***A43B 7/16*** | (2006.01) |
| ***A43B 7/24*** | (2006.01) |
| ***A43B 17/02*** | (2006.01) |

(56) References Cited

U.S. PATENT DOCUMENTS

| | | | | | |
|---|---|---|---|---|---|
| 2,959,874 | A | * | 11/1960 | Schlesinger | 36/34 R |
| 3,377,723 | A | * | 4/1968 | England | 36/39 |
| 3,414,908 | A | * | 12/1968 | Dadson et al. | 623/38 |
| 3,680,231 | A | * | 8/1972 | Dymond | 36/59 R |
| 3,731,323 | A | * | 5/1973 | Glancy | 623/27 |
| 3,738,373 | A | * | 6/1973 | Glancy | 36/144 |
| 3,777,419 | A | * | 12/1973 | Nalick | 36/71 |
| 3,929,139 | A | * | 12/1975 | Salzman | 36/142 |
| 4,882,856 | A | * | 11/1989 | Glancy | 36/43 |
| 5,036,604 | A | * | 8/1991 | Rosen | 36/88 |
| 5,138,774 | A | * | 8/1992 | Sarkozi | 36/164 |
| 6,098,319 | A | * | 8/2000 | Epstein | 36/159 |
| 6,226,901 | B1 | * | 5/2001 | Rosen | 36/159 |
| 6,604,301 | B1 | * | 8/2003 | Manoli et al. | 36/43 |
| 7,913,429 | B1 | * | 3/2011 | Wert | 36/159 |
| 7,950,167 | B2 | * | 5/2011 | Nakano | 36/28 |
| 7,950,168 | B2 | * | 5/2011 | Nakano | 36/28 |
| 2003/0150137 | A1 | * | 8/2003 | Rosen | 36/144 |
| 2006/0130365 | A1 | * | 6/2006 | Sokolowski et al. | 36/35 R |
| 2007/0079532 | A1 | * | 4/2007 | Ramirez | 36/140 |
| 2008/0060229 | A1 | | 3/2008 | Epstein | |
| 2011/0000101 | A1 | * | 1/2011 | Nakano | 36/12 |

FOREIGN PATENT DOCUMENTS

| | | |
|---|---|---|
| EP | 1994845 | 11/2008 |
| GB | 1366270 | 9/1974 |
| WO | WO03/068013 | 8/2003 |
| WO | WO2005/011422 | 10/2005 |
| WO | WO2006/057978 | 6/2006 |
| WO | WO2007/058881 A2 | 5/2007 |

OTHER PUBLICATIONS

Patent Examination Report No. 1, 2 pages, Australian Government IP.

International Preliminary Report on Patentability, The International Bureau, WIPO, 18 pages.

* cited by examiner

FOOTWEAR ITEM

The present invention relates to a footwear item. In particular, the present invention relates to an orthotic or other footwear item for addressing bio-mechanical problems associated with a person's feet such as excessive pronation and supination.

Excessive pronation and supination of the feet are known problems whereby there is excessive unidirectional movement in the human subtalar joint complex such that a person's feet may rotate inwards (towards the inner or 'medial' edge) or outwards (towards the outer or 'lateral' edge), respectively, as weight is applied. Such problems in foot function can result in heel, shin, knee and lower back pain and can lead to various debilitating pathologies.

Known orthotic devices used to correct such bio-mechanical problems include compensatory shoe inserts, which are formed to act generally in the heel area to raise/tilt one side of the heel, to thereby re-align the foot and ankle bones to their neutral position and thus correct the problem. Such external correction to realign the optimum skeletal position can ease pain directly associated with the condition and prevent or reduce the associated debilitating pathologies.

The devices may be custom-made to address a user's particular needs, or may be mass produced in a limited selection of sizes and configurations, with the option of adding pads to adjust the device to meet the requirements of a particular user.

Custom-made orthotic devices are more desirable, since the size, shape and tilt angle are specifically designed for the user by a qualified podiatrist. However, this procedure involves the podiatrist assessing the requirements of the user and drawing up a prescription in accordance with their requirements. The insert then has to be manufactured by skilled technicians to match the prescription. One or more stages of testing the device on the user are also be required, following which the insert may need to be returned to the manufacturer for any necessary adjustments. This process is time consuming and expensive. Moreover, it is often desirable to gradually increase the angle of tilt over time. In this case, several new devices will be required, again increasing cost.

Mass-produced devices are cheaper for the user, but are only available in a small number of tilt angle options, for example, a 4° lateral wedge shoe insert, which comprises a wedge that raises the heel 4° from horizontal. Therefore, the correction capabilities of such devices can be somewhat crude, and may not suitably address the problem. In certain cases, such devices may even create additional problems.

Mass-produced devices of this type can be tailored to meet the requirements of a particular user more precisely through the addition of wedge-shaped pads which can be used to alter the degree of tilt achieved by the device. However, such pads only result in an a relatively crude incremental adjustment of the tilt, with the result that the precise tailoring that may be achieved with custom-made devices is not achievable.

Moreover, such devices allow the wearer to adjust their own device in a manner that can not be distinguished from the adjustments made by their podiatrist. Accordingly, the podiatrist could potentially be held liable for any adverse effects caused by non-authorised adjustments to the device.

The present invention seeks to address the problems of the prior art.

According to a first aspect of the present invention there is provided a footwear item for tilting a wearer's foot to address bio-mechanical problems, the item comprising:— a receiving portion for receiving all or part of the user's foot;

first and second wedge-shaped portions for acting in combination to apply a tilt to the receiving portion;

wherein the second wedge-shaped portion is releasably mountable to the first wedge-shaped portion in a plurality of orientations for adjusting tilt applied to the receiving portion.

By adjusting the relative orientation of the wedge-shaped portions, the degree of tilt and the position from which the tilt is to be applied can be quickly and easily configured to precisely match the requirements of the user.

The present invention thus provides an inexpensive alternative to custom moulded devices, whilst achieving the precise tailoring to the wearer's requirements previously only obtained with such devices.

Moreover, as the second wedge-shaped portion is releasably mounted to the first wedge-shaped portion, the configuration of the device can be readily adjusted if the previous configuration is found to be unsuitable, or if the wearer's requirements change.

The footwear item may comprise engagement means for locating the second wedge-shaped portion on the first wedge-shaped portion in a plurality of discrete orientations. The engagement means may comprise a plurality of projections formed on one of said wedge-shaped portions and a plurality of corresponding notches formed on the other one of said wedge-shaped portions.

The engagement means allows for precise and controlled placement of the second wedge-shaped portion on the first wedge-shaped portion in one of the discrete orientations. This assists the person assembling the item to locate the second wedge-shaped portion correctly, and also prevents the wedge-shaped portions from slipping out of position before being fixed in place.

It will be appreciated that the number of possible configurations of the device, and thus the degree of incremental change achievable with the device, depends, at least in part, on the number of discrete orientations in which the second wedge-shaped portion can be mounted on the first wedge-shaped portion. The present inventors have found that the precise tailoring achieved with previously known custom-made devices can be matched by the present invention if 30 to 50, more preferably about 40 discrete orientations are available. In the case where the engagement means comprises a plurality of projections and corresponding notches, this corresponds to 30 to 50, more preferably about 40 projections, and the same number of notches.

The degree of incremental change available is also dependent on the "wedge-angle", or the angle between opposing surfaces of the wedge-shaped members. This angle is preferably, but not necessarily, the same for each wedge-shaped member. This angle is preferably between about 10° and 30°, more preferably about 20°.

For example, for two wedge-shaped portions with a wedge-angle of 20°, which can be brought together in 40 discrete orientations, the angle of tilt may be varied between 0° and 40°, in increments of 1°.

The wedge-shaped portions are preferably circular, and thus display rotational symmetry in the plane in which the first wedge-shaped portion contacts the second wedge-shaped portion. Thus, the second wedge-shaped portion can be effectively rotated with respect to the first wedge-shaped portion to adjust their relative orientation, and thus the tilt applied to the receiving portion. Similarly, the first wedge shaped portion may be effectively rotated with respect to the receiving portion to adjust the relative orientation of these elements, and thus the tilt applied to the receiving portion.

The first wedge-shaped portion is preferably releasably mountable to the receiving portion. However, in certain embodiments, the first wedge-shaped portion could be permanently mounted to the receiving portion. For example, it could be integrally formed therewith.

In the case where the first wedge-shaped portion is releasably mountable to the receiving portion, the footwear item may comprise further engagement means for locating the first wedge-shaped portion on the receiving portion in a plurality of discrete orientations. The further engagement means may comprise a plurality of projections formed on one of said wedge-shaped portions and a plurality of corresponding notches formed on the other one of said wedge-shaped portions.

This results in further possible configurations of the device, and thus improves the ability of the device to be tailored to the requirements of the wearer.

In a preferred embodiment, the first wedge-shaped portion is mountable on the receiving means in two discrete orientations. Preferably, the first of the two discrete orientations corresponds to a thickest part of the first wedge-shaped portion being located on one of the left and right sides of the receiving portion, and the second of the two discrete orientations corresponds to said thickest part being located at the other of said left and right sides.

Thus, the item can be configured to provide tilt from the right or the left depending on the requirements of the user. The second wedge-shaped member can then be effectively rotated through its plurality of discrete orientations with respect to the first wedge-shaped member, to adjust the degree of tilt applied, and to vary the precise angle from which the tilt is applied.

The footwear item may further comprise a first indicator means provided on one of the wedge-shaped portions, for alignment with one of a plurality of second indicator means provided on the other wedge-shaped portion, wherein the second indicator means correspond to the plurality of discrete orientations of the second wedge-shaped member relative to the first wedge-shaped member.

For example, the first indicator means may be provided on the first wedge-shaped member, whilst the second indicator means may be provided on the second wedge-shaped member, and may be positioned to indicate the locations of the projections or notches formed thereon.

The first indicator means can thus be aligned with one of the second indicator means, to achieve a desired configuration. This allows the item to be configured according to a prescription.

The second indicator means may uniquely identify each of the plurality of discrete orientations of the second wedge-shaped member relative to the first wedge-shaped member.

This enables the requirements of a wearer to be defined in terms which can be directly related to the relative orientation of the wedge-shaped members. This enables the item to be assembled by a technician, rather than by the podiatrist or other expert.

In the case where the first wedge-shaped portion is releasably mountable on the receiving portion in a plurality of discrete orientations, a further indicator means may be provided on either the first wedge-shaped portion or the receiving portion, for alignment with a further plurality of indicator means provided on the other of said portions which correspond to said plurality of discrete orientations.

The footwear item preferably further comprises securing means for securing the first and second wedge-shaped portions in position.

Thus, once the components are assembled in the desired orientation, they may be secured in position such that the item can be used.

The securing means preferably comprises:— first and second retaining members for pressing on opposite outer surfaces of the assembled item to hold the components thereof together; and a shaft for insertion through openings formed in the receiving portion and the first and second wedge-shaped portions, and for connecting said first and second retaining members.

The retaining members thus prevent the receiving portion and the first and second wedge-shaped portions disengaging. The shaft may be suitably dimensioned to prevent substantially any relative movement of the components of the item. Thus, the relative orientations of the components can not be adjusted when secured in place by the securing means.

A first of said outer surfaces may be a surface of the receiving portion, and the second may be a surface of the second wedge-shaped portion. The first outer surface is preferably substantially parallel to a plane in which the receiving portion contacts the first wedge-shaped portion. To achieve this, the first surface may be a recessed surface of the receiving means.

This ensures that the first wedge-shaped portion can be tightly held against the receiving portion by the securing means, even in the case where the outer surface of the receiving means itself is not flat, which may be the case where the receiving portion is shaped to accommodate the user's foot.

The second outer surface is preferably substantially parallel to a plane in which the first wedge-shaped portion contacts the second wedge-shaped portion. To achieve this, the second surface is a recessed surface of the second wedge-shaped portion.

This configuration is required because the angle of the other surface of the second wedge-shaped member will vary with respect to the plane of the first outer surface, depending on the orientation of the second-wedge-shaped portion. In contrast, the plane in which the first wedge-shaped portion contacts the second wedge-shaped portion will be constant for any given orientation of the first wedge-shaped portion. Thus, with this configuration, the second wedge-shaped portion will be tightly held against the first wedge-shaped portion, irrespective of their relative orientation.

When assembled, the first retaining member is preferably inclined with respect to the second retaining member by an angle substantially equal to the wedge angle of the first wedge-shaped member. In this case, the shaft preferably extends substantially perpendicularly to the second retaining means, but may alternatively extend substantially perpendicularly to the first retaining means.

As mentioned above, the plane in which the first wedge-shaped portion contacts the second wedge-shaped portion will be constant for any given orientation of the first wedge-shaped portion. The footwear item therefore preferably further comprises means for mounting the securing means in a predetermined orientation with respect to the first-wedge-shaped portion.

In this respect, the receiving portion may comprise first and second openings, each being configured to receive one of a first projection formed on the securing means and a second projection formed on the first wedge-shaped portion, when the securing means and the first wedge-shaped portion are mounted on the receiving portion;

such that, when the first wedge-shaped portion is mounted on the receiving portion with the first projection located in the first opening, the securing means must be oriented with the second projection located in the second opening, and when the first wedge-shaped portion is mounted on the receiving portion with the first projection located in the second opening, the securing means must be oriented with the second projection located in the first opening.

Thus, the first wedge-shaped portion and the securing means may each be mounted on the receiving means in two alternative orientations. However, once the orientation of one of these elements is fixed, the orientation of the other is also fixed.

The securing means may comprise:— a first securing member comprising said shaft and the first retaining member; and a second securing member comprising the second retaining member and means for releasably engaging said first securing member.

Thus, once secured in place, the securing means may be released to allow the item to be reconfigured.

Alternatively, the securing means may comprise:— a first securing member comprising said shaft and the first retaining member; and a second securing member comprising the second retaining member and means for permanently engaging said first securing member.

Thus, once secured in place, the first and second securing members can not be released without breaking the securing means. Thus, if it is desired to reconfigure the footwear item, a new securing means will be required. Typically, these will not be readily available to the general public, meaning that a user will be prevented from reconfiguring the item themselves. However, if necessary, it will be straightforward for their podiatrist or other expert to reconfigure the device using a new securing means.

Preferably, the securing members may be both releasably or permanently engaged.

According to a second aspect of the present invention, there is provided a method of assembly of a footwear item, comprising:— providing a receiving portion for receiving all or part of the wearer's foot;

mounting a first wedge-shaped portion to the receiving portion in a selected one of a plurality of available orientations;

mounting a second wedge-shaped portion to the first wedge-shaped portion in a selected one of a plurality of available orientations;

to thereby apply a desired tilt to the receiving portion.

The method may further comprise:— identifying the requirements of the wearer in terms that correspond to the alignment of indicator means provided on any or all of the receiving portion and the first and second wedge-shaped portions; and selecting the orientation of the first and second wedge-shaped portions to align the respective indicator means in accordance with the identified requirements of the user.

The method may further comprise securing the receiving portion and the first and second wedge-shaped portions in position, once mounted in the selected orientation.

Examples of the present invention will now be described with reference to the following figures, in which:—

Figure 1:
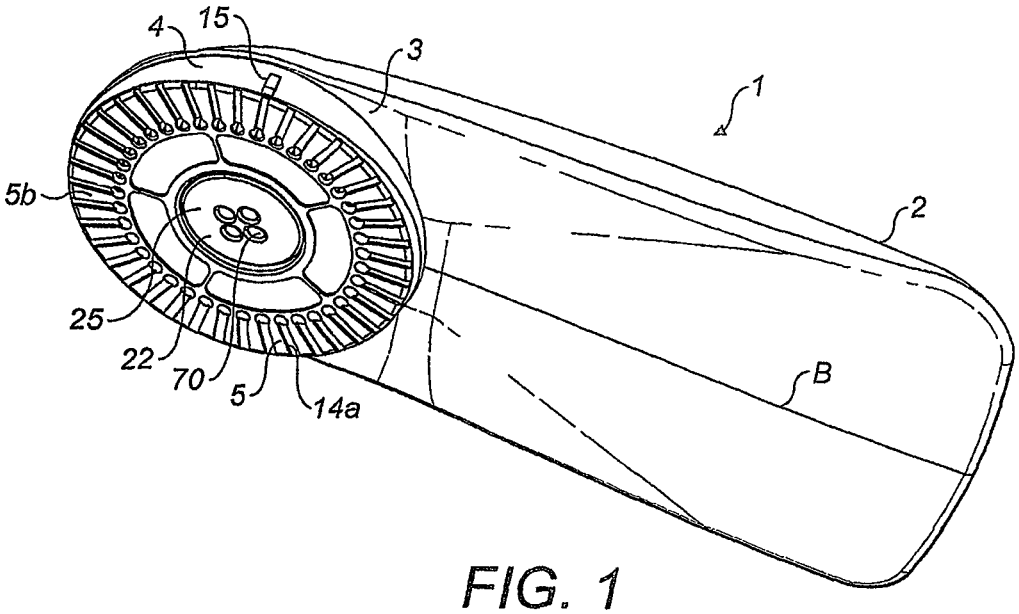
FIG. 1 is a perspective view of the underside of a shoe insert which embodies the present invention.
Figure 5A:
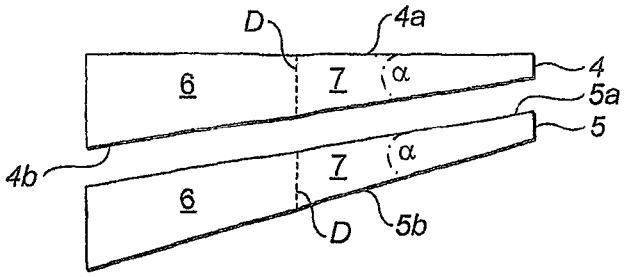
Figure 5B:
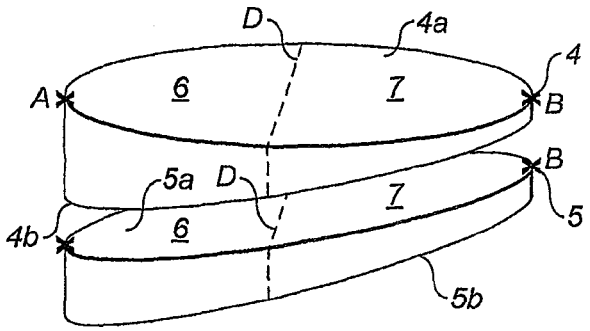
Figure 6A:
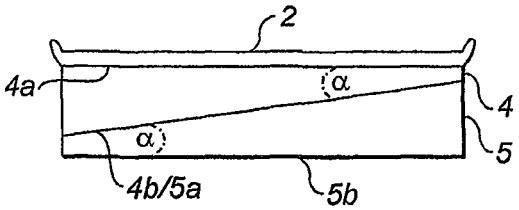
Figure 6B:
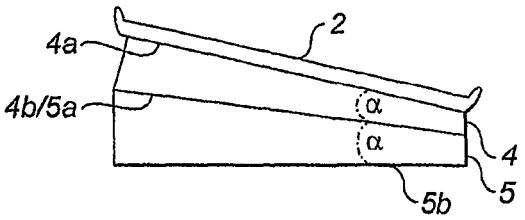
Figure 7:
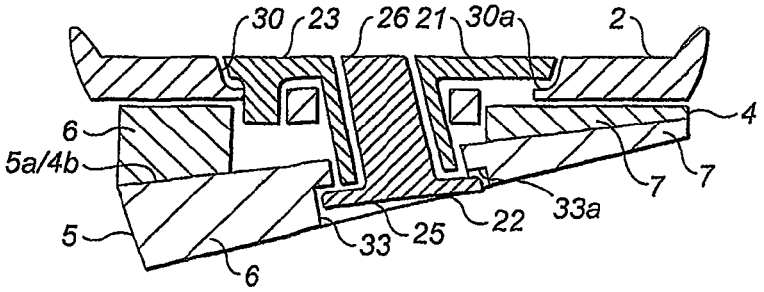

FIGS. 5*a* and 5*b* illustrate the general form of the heel members of the shoe insert of FIG. 1;

FIGS. 6*a* and 6*b* show exemplary configurations of the heel members of the shoe insert of FIG. 1;

FIG. 7 is a cross-sectional view of the shoe insert of FIG. 1, which illustrates the angle of the locking mechanism.

Where appropriate, elements common to more than one component have been given common reference numerals.

FIGS. 5 to 7 are not to scale. In particular, angles and thicknesses have been exaggerated where necessary to demonstrate the principles of the present invention.

The figures illustrate a shoe insert 1 which embodies the present invention.

Figure 2:
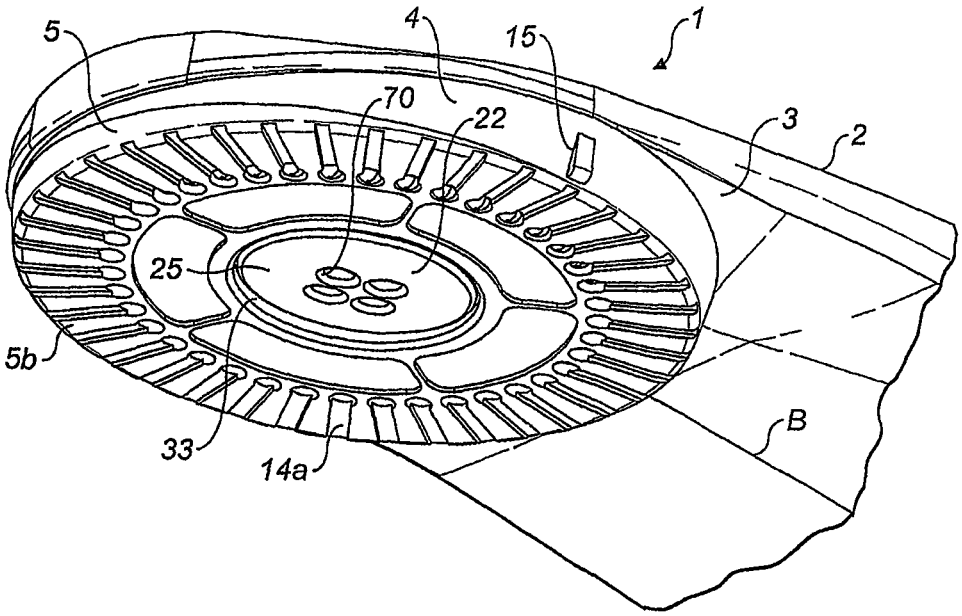
FIG. 2 is an enlarged perspective view of the heel region of the shoe insert of FIG. 1.

With reference to FIGS. 1 and 2, the shoe insert 1 includes a base plate or inner sole portion 2, which extends from the heel region to or towards the toe region of the shoe. The base plate is formed to fit tightly within the user's shoe, and to match the profile of the user's foot. In practice, the base plate may be custom-made to match a cast of the user's foot, may be heat-moulded to fit the user's foot, or may be selected from a range of base plates mass-produced to a variety of predetermined sizes and configurations.

The base plate 2 is elevated at the heel region 3 by a pair of circular heel members 4, 5, attached, one above the other, to the underside of the base plate in the heel region.

The general form of the heel members 4, 5 is illustrated in FIGS. 5*a* and 5*b*. For clarity, the various projections, openings and notches and other details formed on the heel members are not shown in FIGS. 5*a* and 5*b*. The heel members 4, 5 are substantially disk-like in form, with one circular end surface 4*a*, 5*a* inclined to the other 4*b*, 5*b* by an angle $\alpha$ to create a wedge-shape. That is to say, the thickness of each heel portion is greatest at a point A on the circumference, and decreases with a uniform gradient across the heel portion to a minimum thickness at a point B on the circumference diametrically opposite point A. Each of the heel portions thus has a thicker side 6 and a thinner side 7, delineated by a diameter D along which the thickness of the heel member is constant.

As may be seen from FIGS. 1 to 4, the diameter of each heel member 4, 5 is approximately equal to the width of the heel region 3 of the base plate 2. In practice, heel members may be mass produced to a variety of pre-determined sizes so that suitably sized heel portions can be selected to match a particular base plate.

Figure 3:
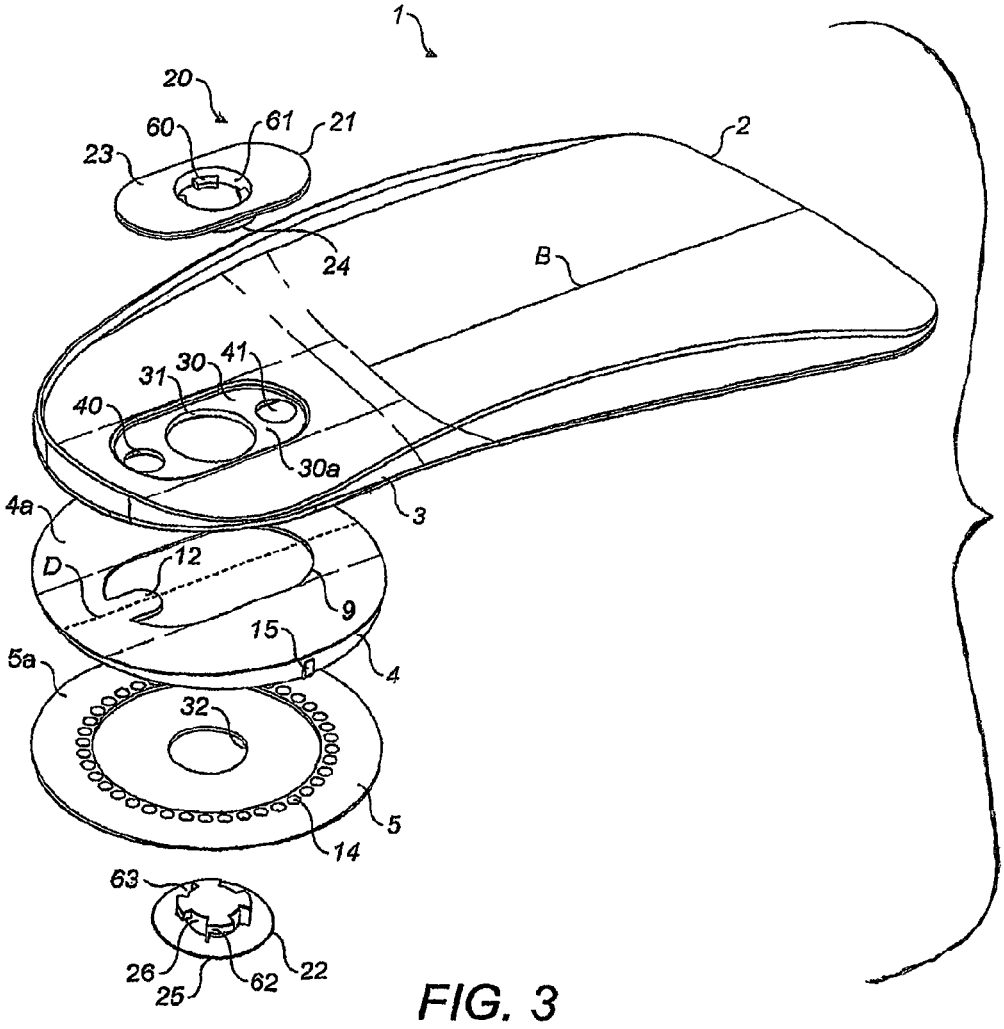
FIG. 3 is an exploded view from above of the shoe insert of FIG. 1.
Figure 4:
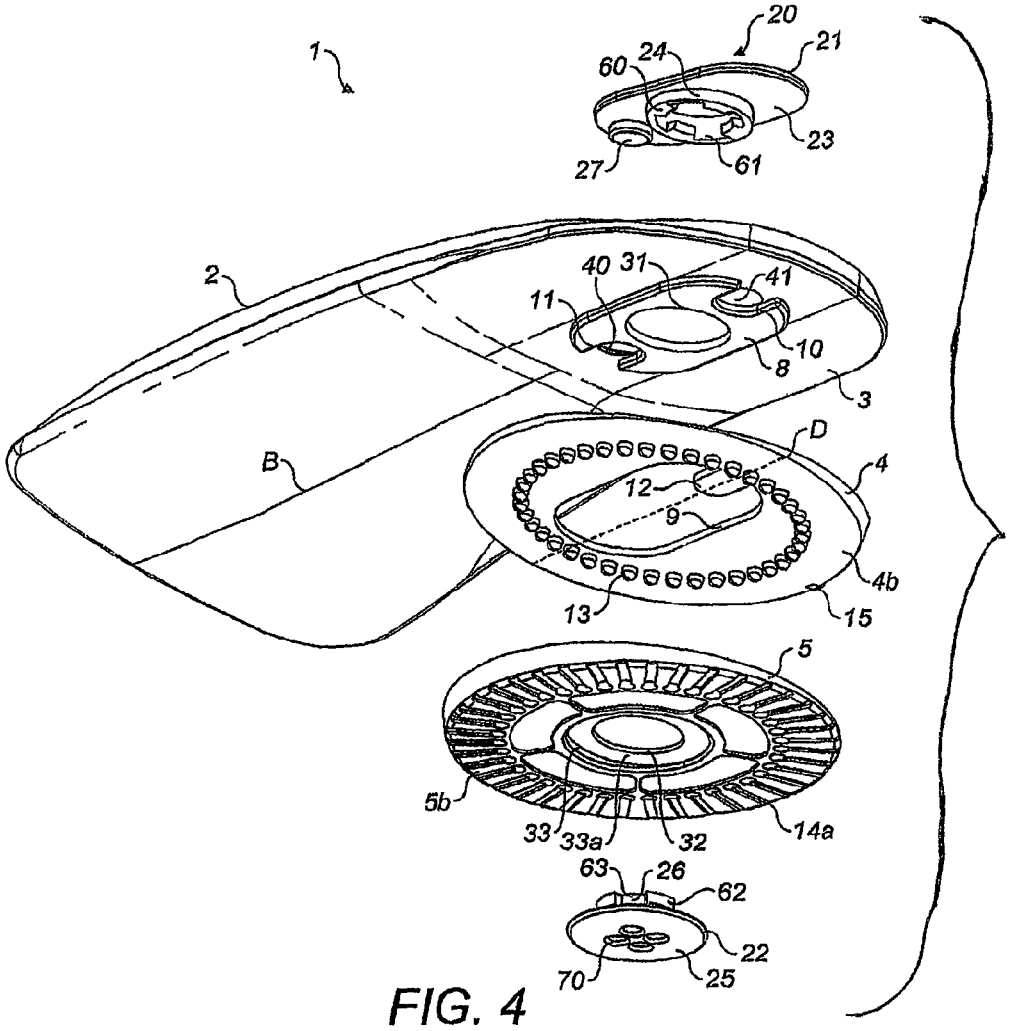
FIG. 4 is an exploded view from below of the shoe insert of FIG. 1.

Referring to FIGS. 3 and 4, a projection 8 (not visible in FIG. 3) is formed on the under side of the base plate 2, for receiving a correspondingly formed opening 9 in the first (upper) heel member 4. The projection 8 is substantially oval in outline, with a substantially U-shaped notch 10, 11 at each curved end. The projection is located substantially centrally on the heel region 3 of the base plate, such that the longitudinal axis of the oval outline is substantially aligned with the longitudinal axis B of the base plate 2. The notches 10, 11 are each bisected by the longitudinal axis of the oval outline of the projection. Alternative orientations of the projection 8 on the base plate 2 are possible, depending on the specific application.

The corresponding opening 9 in the first heel member 4 is also substantially oval in outline, and is located centrally in the first heel member such that the longitudinal axis of the oval outline is aligned on the diameter of constant thickness D of the heel portion. A single tongue-shaped projection 12, formed to engage either one of the U-shaped notches 10, 11 in the projection 8 projects into the opening from one curved end thereof, such that it is bisected by the longitudinal axis of the oval outline of the opening.

The first heel member 4 can thus be positioned with its thicker side 6 (as identified in FIGS. 5*a* and 5*b*) to the right or to the left side of the base plate 2, to provide a tilt from the right or the left side respectively.

As can be seen in from FIG. 3, the upper surface 4*a* of the first heel member 4 is substantially planar, such that it lies flat against the under side of the base plate 2 when mounted on projection 8, as shown in FIGS. 1 and 2.

With reference to FIGS. 3 and 4, the lower surface 4*b* of the first heel portion 4 is provided with a circular arrangement of cylindrical projections 13 (see FIG. 4) which are regularly spaced about the centre of the first heel member, and which extend substantially perpendicularly from the lower surface thereof, for engaging a corresponding arrangement of cylindrical indentations or notches 14 (see FIG. 3) formed in the upper surface 5*a* of the second (lower) heel member 5.

Each of the projections 13 is configured to fit into each of the indentations 14, such that the second heel member 5 can be fitted on to the first heel member in a plurality of orientations which corresponds to the number of projections and corresponding indentations. In the present embodiment, there are 40 projections 13 and 40 corresponding indentations 14. Accordingly, the second heel member can be mounted on the first heel member in 40 different orientations.

As discussed above, the first heel member 4 may be mounted on the base plate in 2 alternative orientations. Thus, 80 different configurations are possible with the shoe insert of the present embodiment.

As can be seen from FIGS. 3, 4 and 5*b*, except for the aforementioned projections and indentations, the lower surface 4*b* of the first heel member 4 and the upper surface 5*a* of the second heel member 5 are substantially planar. These surfaces thus lie flat against one another when the second heel member 5 is mounted on the first heel member 4, irrespective of their relative orientation.

As may be appreciated from FIGS. 6*a* and 6*b*, the degree of tilt applied to the user's heel depends on the angle between the lower surface 5*b* of the second heel member 5 and the base plate 2. With the upper heel portion oriented with its thicker side to the right, the tilt applied to the right side of the heel (ie, the lateral edge in the case of the right foot, or the medial edge in the case of the left foot) can be varied from substantially 0° (FIG. 6*a*) to an angle $2\alpha$ (FIG. 6*b*). Similarly, with the upper heel portion oriented with its thicker side to the left, the tilt applied to the left side of the heel (ie, the medial side in the case of the right foot, or the lateral side in the case of the left foot) can be varied from substantially 0° to an angle $2\alpha$. In the case where $\alpha=20°$, the tilt applied to either side can be varied between substantially 0° to 40° through substantially 1° increments.

Referring again to FIGS. 3 and 4, to assist in determining the relative orientation of the upper and lower heel portions, a marker 15 is provided at predetermined position on the circumferential edge of the first heel member 4, and a series of marker grooves 14*a* (see FIG. 4) are provided on the lower surface 5*b* of the second heel member 5. The marker grooves extend radially outwards from positions which corresponds to the positions of the indentations 14 to the circumferential edge of the second heel member 5, such that they can be readily aligned with the marker notch 15 on the first heel member, and such that they are visible both from the bottom of the device, and from the side.

Although not visible in the figures, a letter, number or other symbol may be allocated to each of the marker grooves 14*a*, to enable a podiatrist or other expert to specify the degree of tilt required by the user in terms which define the positional relationship of the first and second heel members 4, 5 required to achieve that tilt.

Still with reference to FIGS. 3 and 4, the first and second heel members 4, 5 are held in position on the base plate 2 by means of a two-part locking mechanism 20 which comprises a first locking member 21 and a second locking member 22.

The first locking member 21 comprises a retaining member 23 in the form of a retaining lip or flange which is substantially oval in outline, for engaging the base plate 2. A hollow cylindrical member or shaft 24 extends therefrom for insertion through openings in the base plate 2 and the heel members 4, 5. The second locking member 22 comprises a further retaining member 25 in the form of a circular cap for engaging the second heel member 5. A solid cylindrical member or shaft 26 extends from the circular cap 25, and is configured to slide inside and engage with the hollow shaft 24 of the first locking member 21, as discussed in more detail below.

As can be seen in FIG. 3, an oval recess 30 is formed in the upper surface of the base plate 2. The oval recess is located immediately above the projection 8 shown in FIG. 4. The recess 30 is for receiving the retaining lip 23 of the first locking member 21. The recess 30 is substantially similar in size and outline to the projection 8, except for the U-shaped notches at each end. As with the projection 8, the recess 30 is located substantially centrally on the heel region 3 of the base plate 2 and such that the longitudinal axis of the oval outline of the recess is substantially aligned with the longitudinal axis B of the base plate 2.

As shown in both FIGS. 3 and 4, an opening 31 is formed in the centre of the recessed surface of the base plate 2 and extends through the projection 8 to form a circular through hole for receiving the hollow shaft 24 of the first locking member 21. When mounted on the base plate 2, the end of the hollow shaft 24 will project through opening 31, and thus through the opening 9 of the first heel portion 4 when mounted on the base plate. A further through hole 32 is formed at the centre of the second heel member 5, through which the hollow shaft 24 is accessible. The solid shaft 26 of the second locking member 22 can thus be inserted into the hollow shaft of the first locking member 21, and locked in place, as described in more detail below.

For the comfort of the user, the retaining lip 23 of the first locking member 21 is configured to lie substantially flush with the upper surface of the base plate 2.

As can be seen from FIGS. 4 and 7, a circular recess 33 is formed in the lower surface 5*b* of the second heel member 5 for receiving the circular cap 25 of the second locking member 22. As can be seen most clearly from FIG. 7, the recessed surface 30*a* for receiving the retaining lip 23 of the first locking member 21 lies substantially parallel to the base plate 2. However, in order to accommodate the second heel member 5 when mounted in any one of the plurality of orientations discussed above, it is necessary for the recessed surface 33*a* of the circular recess 33 formed in the second heel member 5 to be parallel with the plane in which the second heel member contacts the first heel member. That is to say, it must be parallel to the upper surface 5*a* of the second heel member.

In the present embodiment, the hollow shaft 24 of the first locking member 21 extends from the first retaining means at an angle of substantially $90°-\alpha$ to the retaining lip 23, whilst the solid shaft 26 of the second locking member 22 extends substantially perpendicularly to the circular cap 25. The shafts 24, 26 thus do not obstruct the placement of the second heel member on the first heel member in any of the plurality of orientations.

It will be appreciated that in order for the components to fit together correctly, the first locking member 21 must be positioned correctly with respect to the first heel member 2. In this respect, FIG. 7 illustrates the case where the first heel member is located with its thicker part 6 located to the right (as viewed in the figure), and the locking mechanism correctly oriented. However, if the second heel member 4 is oriented with its thicker part 6 to the left (as viewed in the figure), with the locking mechanism 20 in the same position, the locking mechanism would not be correctly oriented. To account for this, the locking mechanism must be positioned in the opposite orientation. To ensure the correct orientation of the locking mechanism, it is thus necessary to control the relative orientation of the first locking member 21 and the first heel member 4.

To this end, second and third through holes 40, 41 are formed in the recessed surface 30*a* of the base plate 2, at either end of the oval recess 30, as can be seen in FIGS. 3 and 4. As can be seen more clearly from FIG. 4, the through holes 30, 40 extend into the spaces formed by the U-shaped notches 10, 11 in the projection 8 on the under side of the base plate. Each through hole 40, 41 has a diameter that substantially matches the diameter of the curved part of the U-shaped notches, such that the curved part of each notch extends smoothly into the side of the respective through hole.

With reference to FIG. 4, a corresponding circular projection 27 is formed at one curved end, on the under side of the oval retaining lip 23 of the first locking member 21. Thus, when the first locking member 21 is located in the oval recess 30 on the base plate 2 (see FIG. 3), the circular projection 27 will extend through one or other of the through holes 40, 41, and into the space defined by the respective notch 10, 11.

However, as discussed above and with reference to FIGS. 3 and 4, when mounted to the base plate 2 the tongue-shaped projection 12 of the first heel member 4 enters one of the U-shaped notches 10, 11, depending on the selected orientation. The presence of the tongue-shaped member 12 prevents the circular projection 27 from entering that notch. Thus, the first locking member 21 can only be oriented with the circular projection 27 in the other notch. If it is desired to change the orientation of the first heel member 4, the tongue-shaped member 12 will have to be located in the other notch, such that the orientation of the first locking member 21 must also be changed.

With reference again to FIGS. 3 and 4, the first and second locking members 21, 22 lock together by means of a plurality of projections 60, 62 and corresponding gaps 61, 63 formed at the opposite ends of the shafts 24, 26 to the respective retaining members 23, 25. In this respect, the first locking member 21 comprises four projections 60 which extend radially inwardly of the hollow shaft 24, to define four gaps 61 for receiving correspondingly formed projections 62 on the shaft 26 of the second locking member 21. The shaft 26 and projections 62 of the second locking member 21 are formed to be slidable into the hollow shaft 23 of the first locking member 21 when the projections 62 of the second locking member 22 are aligned with the gaps 61 of the first locking member 21. Once the projections 62 have moved past the projections 60, the second locking member 22 can be twisted, such that the end faces of the projections 60, 62 of the respective locking members abut against one another, to prevent separation of the locking members.

To unlock the locking mechanism, the second looking member 22 can be twisted to realign the projections 62 with the gaps 61, and drawn outwards to separate the two locking members 21, 22. As shown in FIGS. 2 and 4, an arrangement of four notches 70 are formed on the outer surface of the circular cap 25, for engagement with a dedicated tool (not illustrated), to facilitate this manipulation of the second locking member 22.

Once a desired configuration of the components of the shoe insert has been achieved, it is desirable to permanently lock the components of the device in position. This is achieved by means of an interference fit, compression fit, or clipping mechanism. The precise nature of a suitable mechanism will be readily apparent to a person skilled in the art. Thus, the locking members 21, 22 can not be separated without breaking the locking mechanism.

The above described shoe insert 1 will typically be used by a podiatrist or other expert. In this respect, the podiatrist will typically observe a client's gait in order to determine the degree of tilt required to correct the condition, and the angle from which the tilt should be applied.

The podiatrist will then provide a prescription using terminology that defines the relative configuration of the various elements. For example, where a tilt of 9° at the outer edge of the left heel is required, the terminology "L:9L;", could be used. This would indicate that, on the left shoe insert, the first heel member 4 should be oriented with its thicker part to the left of the base plate 2, as viewed from below, and the second heel member 5 should be located to align the groove 14*a* identified as "9" with the marker notch 15 on the first heel member.

The podiatrist will then obtain a suitable base plate 2. In this respect, the base plate may be selected from a variety of available sizes and shapes, in accordance with the size of the user's feet and the nature of their shoes. Alternatively, a heat deformable blank may be chosen, and moulded to fit the user's foot and/or their shoe. In some circumstances a cast of the user's foot may be taken, from which a suitable base plate may be custom moulded.

The podiatrist or their technician will then make up the insert in accordance with the prescription, by mounting the first heel member 4 on the oval projection 8 on the under side of the base plate 2, with the thicker portion 6 of the heel member 4 located at the side from which the tilt is to be applied.

The first locking member 21 will then be inserted through the through hole 31 in the base plate 2, oriented such that the circular projection 27 enters the unoccupied U-shaped projection 10, 11. The second heel member 5 will then be mounted onto the first heel member 4 such that the appropriate groove 14*a* is aligned with the marker notch 15. Finally, the second locking member 21 will be inserted through the hole 32 in the second heel member 5, and aligned correctly with the hollow shaft 24 of the first locking member 21, using the dedicated tool. The second locking member 22 will then be pushed into the hollow shaft 24 and twisted to lock the components of the device in place.

For testing, the locking mechanism may be releasably locked, such that it is straightforward to remove the locking members 21, 22 to adjust the relative configuration of the various components. However, once the correct configuration has been established, the podiatrist or technician may use the dedicated tool to further twist the second locking member 22 such that the locking member is permanently locked, and the components of the device can not be further adjusted without breaking the locking mechanism 20.

Thus, if the user attempts to alter the settings of their insert, they will break the locking means and render the device unusable. This is desirable from the point of view of the podiatrist's (or other expert's) professional liability.

Although the configuration of the device can not be altered without breaking the locking mechanism 20, the base plate 2 and the heel portions 4, 5 remain usable. Moreover, the locking mechanism 20 is relatively inexpensive. Accordingly, if the user's condition changes over time, the podiatrist can simply break the existing lock, reconfigure the device, and lock it together using a new lock. This saves the user the expense of investing in an entirely new device.

In the embodiment described above, the first heel member 4 can be located in two alternative orientations to provide a tilt from the right or the left. However, with a suitable arrangement of projections and/or orientations, the first heel member 4 could be located in further fixed orientations, to adjust the position from which the tilt is applied.

It would also be possible for the first heel member 4 to be fixed relative to the base plate 2. For example, to be integrally formed therewith. In this case, different base plates would be required to achieve tilt at the appropriate angle.

In the embodiment described above, 40 projections 13 and corresponding indentations 14 are provided, to provide 40 possible orientations of the second heel member 5 relative to the first heel member 4. Thus, in the case where $\alpha=20°$, 1° incremental changes in the tilt are available.

However, smaller or larger increments may be achieved by changing the number of projections 13 and corresponding indentations 14. For example, if 80 projections/indentations are provided, 0.5° incremental changes would be possible in the case where $\alpha=20°$.

The range of tilt, and the incremental changes possible may also be varied by changing the angle $\alpha$ of inclination between the upper 4*a*, 5*a* and lower 4*b*, 5*b* surfaces of the heel members 4, 5. For example, in the case where $\alpha=15°$, the tilt can be varied between 0° and 30°, in increments of 0.75° (assuming 40 projections/indentations).

In the embodiment described above, the angle of inclination $\alpha$ between upper 4*a*, 5*a* and lower 4*b*, 5*b* surfaces of the heel members 4, 5 is the same for both heel members. However, these angles need not be identical.

The elements of the above described embodiment are slotted together by means of projections and corresponding notches and openings, and retained in place by means of a tamper proof locking mechanism. However, the tamper proof locking mechanism is not essential to the principles of the present invention. In this respect, the elements may simply be held together by means of a press fit between the elements, or by means of one or more screws or similar attachment means.

Whilst the invention is described above in terms of a shoe insert, it will be appreciated that the principles of the invention could be applied to other footwear items, including shoes or boots themselves. In these cases, the heel portions could constitute the heel of the boot/shoe. Alternatively, the heel portions could be housed inside an external heel, for applying a tilt to an internal surface of the shoe/boot.

The invention claimed is:

1. A footwear insert for tilting a wearer's foot to address bio-mechanical problems, the insert comprising:— a foot receiving component for receiving all or part of a wearer's foot; and first and second wedge components, each having first and second respectively inclined surfaces, the first surface of the first wedge component being mountable against a lower surface of the foot receiving component, and the first surface of the second wedge component being mountable against the second surface of the first wedge component;

wherein the mounted position of the first wedge component on the foot receiving component is rotationally adjustable about an axis perpendicular to the lower surface of the foot receiving component, and the mounted position of the second wedge component on the first wedge component is rotationally adjustable about an axis perpendicular to the second surface of the first wedge component, for altering the angle of inclination of the second surface of the second wedge component with respect to the first surface of the first wedge component, to thereby apply an adjustable tilt to the foot receiving component;

and wherein the insert further comprises a first engagement arrangement for locating the first wedge component on the foot receiving component in one of a first plurality of discrete orientations; and a second engagement arrangement for locating the second wedge component on the first wedge component in one of a second plurality of discrete orientations, wherein the second engagement arrangement comprises a plurality of projections formed on one of said wedge components and a plurality of corresponding notches formed on the other one of said wedge components.

2. A footwear insert as claimed in claim 1, wherein the first engagement arrangement comprises one or more projections formed on one of the first wedge component and the foot receiving component and a plurality of corresponding notches formed on the other of the first wedge component and the foot receiving component.

3. A footwear insert as claimed in claim 1 wherein the first wedge component is mountable on the foot receiving component in two discrete orientations.

4. A footwear insert as claimed in claim 3 wherein the first of the two discrete orientations corresponds to a thickest part of the first wedge component being located on one of the left and right sides of the foot receiving component, and the second of the two discrete orientations corresponds to said thickest part being located at the other of said left and right sides.

5. A footwear insert as claimed in claim 1 further comprising a first indicator provided on one of the wedge components, for alignment with one of a plurality of second indicators provided on the other of the wedge components, wherein the second indicators correspond to the plurality of discrete orientations of the second wedge component relative to the first wedge component.

6. A footwear insert as claimed in claim 1 further comprising a locking mechanism for securing the first and second wedge components in position.

7. A footwear insert as claimed in claim 6, wherein the foot receiving component and the first and second wedge components each include an opening formed therein, and wherein the locking mechanism comprises:— first and second retaining members for pressing on opposite outer surfaces of the foot receiving component and the second wedge component to hold the foot receiving component and the first and second wedge components together; and a shaft for insertion through the openings formed in the foot receiving component and the first and second wedge components, and for connecting said first and second retaining members.

8. A footwear insert as claimed in claim 7 wherein a first of said outer surfaces is a surface of the foot receiving component and the second of said outer surfaces is a surface of the second wedge component.

9. A footwear insert as claimed in claim 8 wherein the first outer surface is parallel to a plane in which the foot receiving component contacts the first wedge component and wherein the second outer surface is parallel to a plane in which the first wedge component contacts the second wedge component.

10. A footwear insert as claimed in claim 7 wherein the first retaining member is inclined with respect to the second retaining member by an angle substantially equal to the angle between the first and second surfaces of the first wedge component.

11. A footwear insert as claimed claim 7 wherein the locking mechanism comprises:— a first securing member comprising said shaft and the first retaining member; and a second securing member comprising the second retaining member and a mechanism for releasably engaging said first securing member.

12. A footwear insert as claimed in claim 7 wherein the locking mechanism comprises:— a first securing member comprising said shaft and the second retaining member; and a second securing member comprising the first retaining member and a mechanism for permanently engaging said first securing member.

13. A footwear insert as claimed in claim 6 further comprising a device for mounting the locking mechanism in a predetermined orientation with respect to the first wedge component.

14. A footwear insert as claimed in claim 13 comprising a first projection formed on the locking mechanism and a second projection formed on the first wedge component, and wherein the foot receiving component comprises first and second openings, each being configured to receive one of the first projection and the second projection, when the locking mechanism and the first wedge component are mounted on the foot receiving component;

such that, when the first wedge component is mounted on the foot receiving component with the first projection located in the first opening, the locking mechanism must be oriented with the second projection located in the second opening, and when the first wedge component is mounted on the foot receiving component with the first projection located in the second opening, the locking mechanism must be oriented with the second projection located in the first opening.

* * * * *